US012618130B2

(12) United States Patent
Stanistreet et al.

(10) Patent No.: US 12,618,130 B2
(45) Date of Patent: May 5, 2026

(54) HOT UNCOILING OF METAL

(71) Applicant: Novelis Inc., Atlanta, GA (US)

(72) Inventors: Timothy Francis Stanistreet, Acworth, GA (US); Mark Finn, Dallas, GA (US); Renato Rufino Xavier, Kennesaw, GA (US); Frank Su, Dallas, GA (US); Louis Mitchell Nazro, Acworth, GA (US); Tudor Piroteala, Woodstock, GA (US); Samuel Robert Wagstaff, Marietta, GA (US); Barbara Lucille Hyde, Tellico Plains, TN (US); David Anthony Gaensbauer, Burlington, VT (US); Sazol Kumar Das, Acworth, GA (US)

(73) Assignee: Novelis Inc., Atlanta, GA (US)

( * ) Notice: Subject to any disclaimer, the term of this patent is extended or adjusted under 35 U.S.C. 154(b) by 684 days.

(21) Appl. No.: 17/915,406

(22) PCT Filed: Oct. 13, 2020

(86) PCT No.: PCT/US2020/055334
§ 371 (c)(1),
(2) Date: Sep. 28, 2022

(87) PCT Pub. No.: WO2021/201912
PCT Pub. Date: Oct. 7, 2021

(65) Prior Publication Data

US 2023/0193441 A1 Jun. 22, 2023

Related U.S. Application Data

(60) Provisional application No. 63/005,014, filed on Apr. 3, 2020.

(51) Int. Cl.
*C22F 1/04* (2006.01)
*B21C 47/24* (2006.01)
*C22F 1/00* (2006.01)

(52) U.S. Cl.
CPC ..... *C22F 1/04* (2013.01); *B21C 47/24* (2013.01); *C22F 1/002* (2013.01)

(58) Field of Classification Search
None
See application file for complete search history.

(56) References Cited

U.S. PATENT DOCUMENTS 2,887,422 A 5/1959 Stone et al.
3,806,376 A 4/1974 Toda et al.
(Continued)

FOREIGN PATENT DOCUMENTS

CN 1112358 A 11/1995
CN 101376212 A 3/2009
(Continued)

OTHER PUBLICATIONS

English translation of JP 2013136083 (originally published Jul. 11, 2013), obtained from PE2E search.*
(Continued)

*Primary Examiner* — George Wyszomierski
(74) *Attorney, Agent, or Firm* — Kilpatrick Townsend & Stockton LLP

(57) ABSTRACT

A system for heat-treating a coil of metal can include a furnace, an unwinding system, and a quenching system. The furnace may receive the coil of metal and elevate a temperature of the metal to be within a pre-heated temperature range, such as a homogenizing temperature range or an annealing temperature range. The unwinding system may unwind at least a portion of the coil in a heated state in which the metal is within the pre-heated temperature range or
(Continued)

before the metal has cooled past a threshold amount below the pre-heated temperature range. The quenching system may receive the unwound portion of the coil from the unwinding device and reduce a temperature of the unwound portion to a within a quenched temperature range within a predetermined amount of time.

15 Claims, 3 Drawing Sheets

(56) References Cited

U.S. PATENT DOCUMENTS

| | | | | |
|---|---|---|---|---|
| 4,016,740 | A | 4/1977 | Gondo et al. | |
| 4,019,359 | A | 4/1977 | Smith | |
| 5,121,902 | A | 6/1992 | Jalil et al. | |
| 5,356,495 | A * | 10/1994 | Wyatt-Mair | C22C 21/06 164/462 |
| 5,701,775 | A | 12/1997 | Sivilotti et al. | |
| 10,844,467 | B2 | 11/2020 | Gaensbauer et al. | |
| 2017/0009325 | A1 | 1/2017 | Wyatt-Mair et al. | |
| 2018/0085803 | A1* | 3/2018 | Hobbis | B21D 37/16 |
| 2018/0087138 | A1 | 3/2018 | Gaensbauer et al. | |
| 2018/0117650 | A1* | 5/2018 | Felberbaum | C22F 1/002 |
| 2019/0010592 | A1 | 1/2019 | Felberbaum et al. | |
| 2022/0033945 | A1* | 2/2022 | Von Czarnowski | C22C 21/00 |
| 2023/0167529 | A1* | 6/2023 | Sánchez Martínez | B32B 15/20 148/695 |

FOREIGN PATENT DOCUMENTS

| | | | |
|---|---|---|---|
| CN | 101804426 | A | 8/2010 |
| CN | 102601115 | A | 7/2012 |
| CN | 203853395 | U | 10/2014 |
| CN | 207227489 | U | 4/2018 |
| CN | 108431249 | A | 8/2018 |
| CN | 108495724 | A | 9/2018 |
| CN | 109890537 | A | 6/2019 |
| CN | 110092152 | A | 8/2019 |
| EP | 3406744 | A1 | 11/2018 |
| EP | 3521223 | A1 | 8/2019 |
| JP | H01122605 | A | 5/1989 |
| JP | 07314037 | A | 12/1995 |
| JP | 2012500119 | A | 1/2012 |
| JP | 2013136083 | A | 7/2013 |
| JP | 2018527186 | A | 9/2018 |
| JP | 2018153865 | A | 10/2018 |
| JP | 2019502562 | A | 1/2019 |
| JP | 2019505667 | A | 2/2019 |
| JP | 2019193951 | A | 11/2019 |
| KR | 10-1988-0000157 | A | 3/1988 |
| KR | 20020049699 | A | 6/2002 |
| KR | 10-2005-0020109 | A | 3/2005 |
| KR | 20-2014-0005855 | U | 1/2014 |
| WO | 2005009640 | A1 | 2/2005 |
| WO | 2008040430 | A1 | 4/2008 |
| WO | 2017007458 | A1 | 1/2017 |
| WO | 2018080707 | A1 | 5/2018 |
| WO | 2018132604 | A1 | 7/2018 |
| WO | 2021076473 | A1 | 4/2021 |

OTHER PUBLICATIONS

EP Application No. 20799954.1, "Office Action", Jan. 10, 2024, 3 pages.
JP Application No. 2022-558568, "Office Action", Feb. 20, 2024, 8 pages.
CN Application No. 202080099367.7, "Office Action", Sep. 28, 2024, 14 pages.
JP Application No. 2022-558568, "Notice of Decision to Grant", Sep. 10, 2024, 7 pages.
KR Application No. 10-2022-7034122, "Office Action", Oct. 21, 2024, 26 pages.
CN Application No. 202080099367.7 , "Office Action", Apr. 22, 2024, 18 pages.
JP Application No. 2022-558568, "Office Action", mailed on Sep. 5, 2023, 7 pages.
PCT/US2020/055327 , "International Preliminary Report on Patentability", Apr. 28, 2022, 6 pages.
PCT/US2020/055327 , "International Search Report and Written Opinion", Feb. 17, 2021, 10 pages.
PCT/US2020/055334 , "International Search Report and Written Opinion", Feb. 4, 2021, 10 pages.
CA Application No. 3,175,153 , "Office Action", mailed on Nov. 30, 2023, 4 pages.
PCT/US2020/055334, "International Preliminary Report on Patentability", Oct. 13, 2022, 7 pages.
EP Application No. 20799954.1, "Office Action", Mailed on Aug. 9, 2023, 4 pages.
CN Application No. 202080099367.7 , "Office Action", Jan. 20, 2025, 21 pages.
EP Application No. 20799954.1 , "Intention to Grant", Mar. 13, 2025, 9 pages.
EP Application No. 20799954.1 , "Office Action", Oct. 29, 2024, 4 pages.
KR Application No. 10-2022-7034122 , "Office Action", Mar. 5, 2025, 8 pages.
Mexican Patent Application No. MX/A/2022/012185, "Office Action", Jun. 5, 2025, 6 pages.
Brazilian Patent Application No. BR112022018285-6, "Office Action", Jul. 1, 2025, 7 pages.
Korean Patent Application No. 10-2022-7034122, "Office Action", Jul. 7, 2025, 6 pages.
Canadian Patent Application No. 3,175,153, "Notice of Allowance", Sep. 5, 2025, 1 page.
Japanese Patent Application No. 2024098728, "Office Action", Sep. 30, 2025, 4 pages.
Mexican Patent Application No. MX/A/2022/012185, "Office Action", Sep. 30, 2025, 8 pages.

* cited by examiner

HOT UNCOILING OF METAL

CROSS-REFERENCE TO RELATED APPLICATIONS

This application claims the benefit of and priority to U.S. Provisional Application No. 63/005,014, filed Apr. 3, 2020, and titled "HOT UNCOILING OF METAL," the content of which is incorporated herein by reference in its entirety for all purposes.

FIELD

The present disclosure relates to metalworking generally and more specifically to systems and methods for processing metal from a coil that may be uncoiled at homogenizing, annealing, or other elevated temperatures.

BACKGROUND

To transport sheets of metal or other material more easily, the material can be coiled around a rotating mandrel. The resulting coil typically can be moved more easily than if the material were transported instead as one or more flat sheets. After transporting to a suitable location, the coil can be subsequently unwound and removed in cut lengths to permit access to the material in separated sheets for further processing or use.

Although useful for transport, the coil form factor may be unconducive to certain other processing activities. For example, certain heat treatment processes involve elevating a material to substantial temperatures and quickly quenching. Such processes may be impracticable to perform on a workpiece corresponding to an entire fully-formed coil, e.g., due to the overall size of the coil having a tendency to retain heat and prevent adequately high heat extraction rates suitable to obtain the desired outcome of a quenching process. Moreover, various materials (such as metal), if handled while in a coil form at high temperature, may be more susceptible to problems (such as scratching, stretching, or welding together of overlapping turns) than if processed in individual layers of discrete, separate, flat sheets. Accordingly, if heat treatment is desired for a coiled material, the material is typically first removed from the coil by cutting off lengths into separate strips prior to any heating operation of the heat treatment, and then the heat treatment is instead individually performed relative to the removed strips, i.e., the respective strips are subjected to suitable heating and quenching operations of the heat treatment process.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Certain examples herein address systems and methods for processing metal from a coil that may be uncoiled at homogenizing, annealing, or other elevated temperatures. For example, the entire coil may be heated at once in a furnace and then unwound while still at an elevated temperature (e.g., while still in the furnace, or shortly after removal from the furnace). This may be more efficient and/or effective in terms of time, space, energy, and/or other criteria than processing a series of individual strips from the coil. The unwound portion of the coil, while still at an elevated temperature may be cooled or quenched by spraying air, water, or other coolant onto the unwound portion of the coil and/or subjected to some other form of quenching system. Since the coil is not separated into individual severed lengths, the resulting quenched portion of the coil can be wound anew and form a new coil. Thus, for example, a heat-treated coil can be obtained without respective drawbacks that might be encountered in a process that instead involves severing the coil into lengths that are individually heated, quenched, and re-attached to one another into a continuous unit for forming a coil.

In various examples, a method for heat-treating a coil of metal is provided. The method may include heating the coil of metal within a furnace to elevate a temperature of the metal to be within a pre-heated temperature range corresponding to a homogenizing temperature range or an annealing temperature range. The method may further include unwinding the coil of metal in a heated state in which the metal is within the pre-heated temperature range or before the metal has cooled past a threshold amount below the pre-heated temperature range. The unwinding may produce an unwound portion of the coil. The method may further include quenching the unwound portion of the coil to reduce a temperature of the unwound portion to a quenched temperature range within a predetermined amount of time. The quenching may produce a quenched portion.

In various examples, a system for heat-treating a coil of metal is provided. The system may include a furnace sized for receiving the coil of metal and configured for elevating a temperature of the metal to be within a pre-heated temperature range corresponding to a homogenizing temperature range or an annealing temperature range. The system may further include an unwinding system operable to unwind at least a portion of the coil in a heated state in which the metal is within the pre-heated temperature range or before the metal has cooled past a threshold amount below the pre-heated temperature range. The system may further include a quenching system configured to receive an unwound portion of the coil from the unwinding system and reduce a temperature of the unwound portion to a quenched temperature range within a predetermined amount of time.

In various examples, another system for heat-treating a coil of metal can be provided. The system may include a furnace sized for receiving the coil of metal and configured for elevating a temperature of the metal to be within a pre-heated temperature range corresponding to a homogenizing temperature range or an annealing temperature range. The system may further include a transport system configured to move the coil away from the furnace in a heated state in which the metal is within the pre-heated temperature range or before the metal has cooled past a threshold amount below the pre-heated temperature range. The system may further include an unwinding system operable to unwind at least a portion of the coil in the heated state at an unwinding location to which the coil has been delivered by the transport system. The system may further include a quenching system configured to receive an unwound portion of the coil from the unwinding system and reduce a temperature of the unwound portion to a quenched temperature range within a predetermined amount of time.

In various examples, another system for heat-treating a coil of metal can be provided. The system may include a furnace sized for receiving the coil of metal and configured for elevating a temperature of the metal to be within a pre-heated temperature range corresponding to a homogenizing temperature range or an annealing temperature range. The system may further include an unwinding system comprising an unwinding mechanism operable on the coil to unwind at least a portion of the coil while the coil is located within the furnace. The system may further include a quenching system configured to receive an unwound portion of the coil from the furnace and reduce a temperature of the unwound portion to a quenched temperature range within a predetermined amount of time.

Other objects and advantages will be apparent from the following detailed description of non-limiting examples.

BRIEF DESCRIPTION OF THE FIGURES

The specification makes reference to the following appended figures, in which use of like reference numerals in different figures is intended to illustrate like or analogous components.

DETAILED DESCRIPTION

Figure 1:
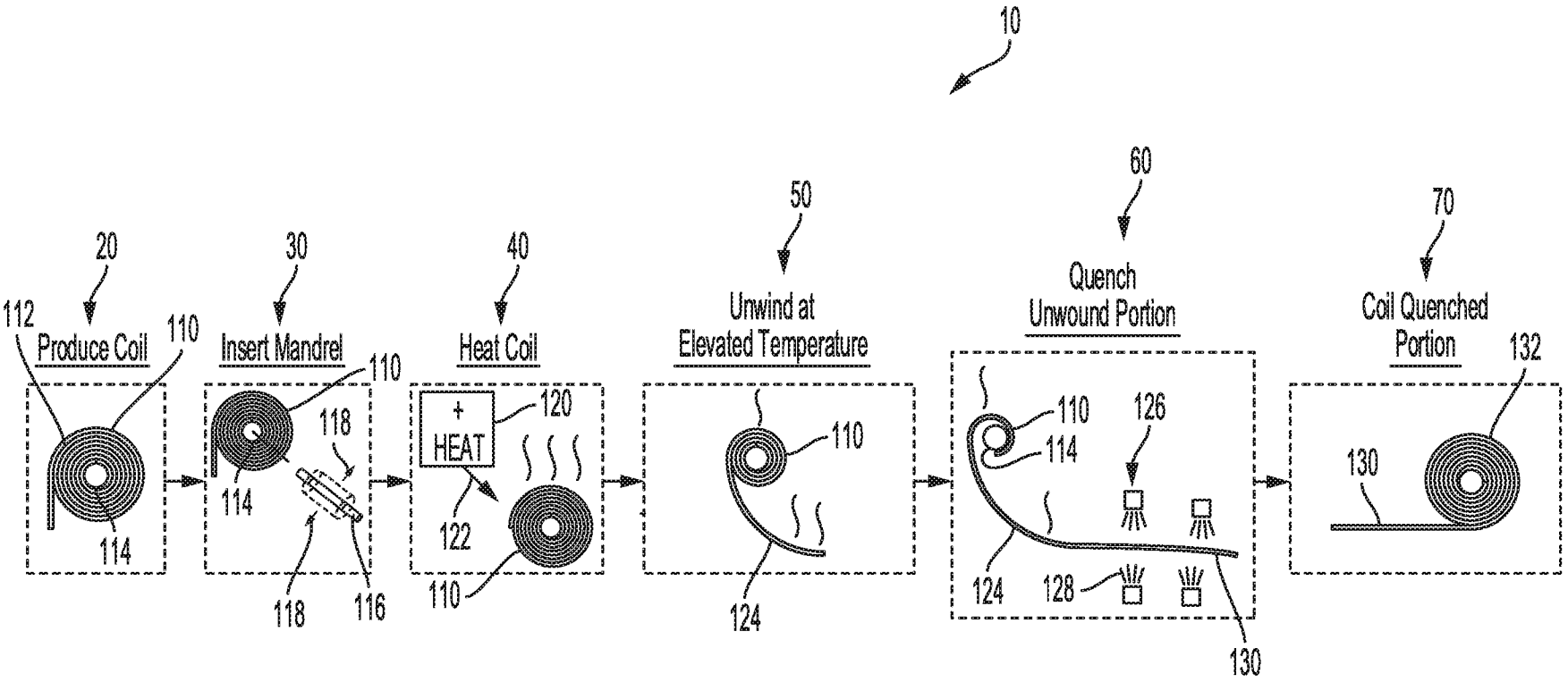
FIG. 1 is a flow chart illustrating a process of heat treating a coil of metal, according to various embodiments.

As used herein, the terms "invention," "the invention," "this invention," and "the present invention" are intended to refer broadly to all of the subject matter of this patent application and the claims below. Statements containing these terms should be understood not to limit the subject matter described herein or to limit the meaning or scope of the patent claims below. The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. As used herein, the meaning of "a," "an," and "the" includes singular and plural references unless the context clearly dictates otherwise.

In material processing and production, continuous casting processes or rolling processes (e.g., hot rolling) can result in a coiled product. Material processing may correspond to or include metal processing. For example, the metal processing may produce a coiled strip of material, such as conductive material. As disclosed herein, conductive material is inclusive of and may correspond to material that allows the flow of an electrical current in one or more directions, for example, metallic material. Suitable material may include articles of any suitable thickness capable of being coiled, for example, a metal sheet or metal shate. A coiled strip can have any suitable length or width. A coil can comprise or correspond to a strip coiled. For example, a metal coil can comprise a metal strip that is coiled around a spool and/or mandrel.

As used herein, a sheet generally refers to a product having a thickness of less than about 4 mm. For example, a sheet may have a thickness of less than about 4 mm, less than about 3 mm, less than about 2 mm, less than about 1 mm, less than about 0.5 mm, or less than about 0.3 mm (e.g., about 0.2 mm). As used herein, a plate generally has a thickness in a range of more than about 15 mm. For example, a plate may refer to an aluminum product having a thickness of greater than about 15 mm, greater than about 20 mm, greater than about 25 mm, greater than about 30 mm, greater than about 35 mm, greater than about 40 mm, greater than about 45 mm, or greater than about 50 mm. As used herein, a shate (also referred to as a sheet plate) generally has a thickness of from about 4 mm to about 15 mm. For example, a shate may have a thickness of about 4 mm, about 5 mm, about 6 mm, about 7 mm, about 8 mm, about 9 mm, about 10 mm, about 11 mm, about 12 mm, about 13 mm, about 14 mm, or about 15 mm.

While certain aspects of the present disclosure may be suitable for use with any type of material, such as metal, certain aspects of the present disclosure may be especially suitable for use with aluminum. In this description, reference is made to alloys identified by aluminum industry designations, such as "series" or "6xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

The following examples will serve to further illustrate the present invention without, at the same time, however, constituting any limitation thereof. On the contrary, various embodiments, modifications and equivalents thereof may, after reading of the description herein, suggest themselves to those skilled in the art without departing from the spirit of the invention.

FIG. 1 is a flowchart illustrating a process 10 of heat treating a coil 110, according to various embodiments. The coil 110 can be made of a suitable material 112, such as metal. In some examples, the metal is aluminum. The process 10 in FIG. 1 includes acts of producing the coil 110 (at act 20), inserting a mandrel (at act 30), heating the coil 110 (at act 40), unwinding the coil 110 (at act 50), quenching (at act 60), and coiling (at act 70), although other acts may be included additionally or alternatively and/or with other variations. In some embodiments, the process 10 may be performed such that the coil 110 may be maintained in a continuous band of material 112 without the band being subject to severing and re-connecting between respective acts of the process 10 or otherwise during the course of the process 10.

At act 20, the process 10 can include producing a coil 110. Producing the coil at 20 may include accessing a coil 110 that was made previously, for example. Alternatively, producing the coil 110 may include fabricating the coil 110. In some embodiments, the coil 110 may be produced by a hot rolling line and optionally a cold rolling line. When the coil 110 is produced or obtained from a hot rolling line, the coil 110 may retain heat imparted by the hot rolling line, for example, which may reduce an amount of heat to be added to reach desired temperatures for the heat treating process 10.

The coil 110 can be formed around a spool 114. For example, the coil 110 may be formed by wrapping a sheet of material 112 in successive overlapping turns about the spool 114. In some embodiments, the spool 114 may be rotated to cause additional layers to be wrapped around the spool 114 and formed into the coil 110. The spool 114 may be in the shape of a tube. In some embodiments, the spool 114 may include an assembly of parts that may allow the spool 114 to change a radial size, for example, in response to dimensional changes that may result from temperature changes during the process 10.

At act 30, the process 10 can include inserting a mandrel 116 into the coil. The mandrel 116 may engage the spool 114 in a manner that may facilitate subsequent rotating of the spool 114 for rotating the coil 110. In some embodiments, the spool 114 and/or the mandrel 116 may be expandable (e.g., as illustrated by arrows 118), for example, to permit radial expansion for adapting to a change in size of an inner diameter of the spool 114 that may result from the coil 110 being heated during the process 10. Although the act 30 of inserting the mandrel 116 is shown before the act 40 of heating the coil 110, in some embodiments, the mandrel 116 may be inserted after the coil 110 is heated. In other words, the act 30 of insertion can occur after, before, or during the act 40 of heating of the coil 110.

Various suitable mechanisms and structures may be used for causing expansion of the mandrel 116 and/or the spool 114. Non-limiting examples include clam-like structures (such as with hinged halves and a spring separator or other biasing mechanism that can separate the parts), a tooth and pin arrangement, or nesting tubes. In some examples, one or more of the components that cause the expansion may be commercially available components. The act of inserting the mandrel 116 into the spool 114 may be what expands the spool 114.

At act 40, the coil 110 can be heated. For example, the heating may correspond to adding heat 120 to the coil 110 (e.g., as depicted by arrow 122) for pre-heating the coil 110 to be within a particular pre-heated temperature range. To achieve the heating at act 40, the coil 110 may be maintained in a furnace or other heated environment for a suitable amount of time to allow the material 112 of the coil 110 to reach a point of being within the particular pre-heated temperature range. In some embodiments, the pre-heated temperature range may be a homogenizing temperature range, for example. In some embodiments, the pre-heated temperature range may be an annealing temperature range, for example.

In some aspects, the homogenizing temperature range is defined by endpoints selected within the range of 400° C. to 600° C. In some embodiments, the endpoints are selected within the range of 450° C. to 560° C. In some aspects, the homogenizing temperature range may be selected based on a type of alloy to be processed. For example, 450° C. to 500° C. may be an appropriate range for homogenizing 7xxx alloys, whereas 530° C. to 560° C. may be an appropriate range for homogenizing 6xxx alloys.

More generally, the homogenizing temperature range may correspond to a suitable range for homogenization. Homogenization may refer to a high-temperature process performed on metal articles to reduce the grain-level heterogeneity of an as-cast microstructure. Homogenization is often performed at temperatures above the metal's recrystallization temperature. For example, in some types of aluminum alloy, the metal's recrystallization temperature may be around 300-400° C. and homogenization may be performed at temperatures of around 450-600° C. When heated to these ranges of temperatures (e.g., at or above the recrystallization temperature), the metallurgical microstructure of the metal article can become more homogenous, improving the formability of the metal article and/or other metallurgical properties. However, at these high temperatures, the metal article may be especially susceptible to damage if mistreated.

In some aspects, the annealing temperature range is defined by endpoints selected within the range of 300° C. to 500° C. In some embodiments, the endpoints are selected within further ranges, such as a range of 400° C. to 500° C., a range of 300° C. to 400° C., or a range of 350° C. to 400° C., or a range of 300° C. to 450° C. In some aspects, the annealing temperature range may be selected independent of a type of alloy to be processed. For example, 300° C. to 450° C. may be an appropriate range for annealing, regardless of whether processing 7xxx alloys, 6xxx alloys, or other series of alloys.

More generally, the annealing temperature range may correspond to a suitable range for annealing. Annealing may refer to a high-temperature process performed on metal articles to achieve any of a number of effects. Without intending to limit the present disclosure, the purpose for the annealing and the annealing parameters may include (1) releasing the work-hardening in the material to gain formability; (2) recrystallizing or recovering the material without causing significant grain growth; (3) engineering or converting texture to be appropriate for formability and for reducing anisotropy during forming; and/or (4) avoiding the coarsening of pre-existing precipitation particles. The annealing can result in an alloy with improved texture and/or with reduced anisotropy during forming operations, such as stamping, drawing, or bending. By applying annealing, the texture in a modified temper may be controlled/engineered to be more random and to reduce those texture components that can yield strong formability anisotropy (e.g., Goss, Goss-ND, or Cube-RD). This improved texture can potentially reduce the bending anisotropy and can improve the formability in the forming where a drawing or circumferential stamping process is involved, as it acts to reduce the variability in properties at different directions. However, at the high temperatures suitable for annealing, the metal article may be especially susceptible to damage if mistreated.

In some embodiments, the heating at act 40 can include multiple stages with respective temperature ranges and dwell times. For example, in some embodiments, the heating at act 40 can include one stage of maintaining the coil 110 in a pre-heated temperature range suitable for annealing and afterward or beforehand can include another stage of maintaining the coil 110 in a pre-heated temperature range suitable for homogenizing.

The heating at act 40 can be provided at any suitable rate. For example, in some embodiments, the heating may occur at a heating rate in the range of 20° C./hour-100° C./hour. In some embodiments, slow heat up (e.g., 20° C./hour-40° C./hour) may facilitate nucleation of dispersoid using dissolving precipitates as heterogeneous nucleation sites. This may also ensure uniform distribution of solute in matrix rather than incipient melting at the interface between precipitate and matrix.

At act 50, the process 10 can include unwinding the coil 110. The unwinding may occur while the coil 110 is in an elevated temperature range (e.g., which may correspond to the pre-heated temperature range imparted by the heating at act 40 or a different range that is within a threshold amount below the pre-heated temperature range). For example, the unwinding may occur while the coil 110 is in a furnace or while still at an elevated temperature after removal from a furnace. In various embodiments, the unwinding may occur while the coil is in a heated state in which the metal is within the homogenous temperature range and/or before it has cooled past a threshold amount below the homogenous temperature range or other relevant pre-heated range (such as an annealing temperature range). In some embodiments, the threshold amount that may be pertinent may be 50° C. or less. For example, before being unwound, the coil may cool less than 50° from the temperature at which it was removed from the furnace. In some embodiments, the threshold amount may be selected to avoid a nose or drop along a continuous cooling transformation (CCT) curve and/or to avoid undesired precipitation in the coil. The threshold amount may be selected based on a type of alloy to be processed, such as whether processing 7xxx alloys, 6xxx alloys, or other series of alloys.

The unwinding at 50 may be a result of the mandrel 116 and/or spool 114 being rotated. The unwinding may produce an unwound portion 124 of the coil 110. The unwound portion 124 of the coil 110 may be processed by other acts in the process 10.

At act 60, the process 10 can include quenching the unwound portion 124 of the coil 110. For example, this may be accomplished by subjecting the unwound portion 124 to a quenching system 126. The quenching system 126 may have suitable structure for delivering a quenching medium 128. For example, although jets are shown in FIG. 1, a bath or other delivery system for quenching medium may be utilized. Suitable quenching mediums may include, but are not limited to, air, water, or oil. The act 60 of quenching in the process 10 may produce a quenched portion 130 of the coil 110.

The quenching at 60 may involve reducing the temperature in the unwound portion 124 of the coil 110 to reach a quenched temperature range within a predetermined amount of time. The quenching at 60 may include rapid quenching (e.g., imparting a temperature reduction within minutes or seconds or over some other short predetermined amount of time) or extended cooling (e.g., imparting a temperature reduction within hours or over some other lengthy predetermined amount of time). In some embodiments, the quenching or types thereof may be defined in terms of heat extraction rate, for example, such that a rapid quenching may relate to a heat extraction rate of greater than 10° C./s or such that an extended cooling may relate to a heat extraction rate of less than 10° C./s.

The quenching at 60 may be defined by any suitable parameter or combination of parameters in addition to or in lieu of heat extraction rate, however. In a non-limiting example that may illustrate some possible relevant parameter types, a coil 110 heated to 525° C. at act 40 may cool by an amount of approximately 25° C. to reach a temperature of approximately 500° C. prior to the quenching at act 60, which may utilize water (at room temperature (e.g., 20° C.-22° C.) or at some other temperature, such as within a range of between 25° C.-80° C.) sprayed through a series of jets to reduce a temperature of the material 112 of the coil 110 to 350° C. over a time interval of approximately 1.5 seconds to 15 seconds to produce a quenching rate or heat extraction rate between 10° C./s-100° C./s. However, other values may be utilized.

For example, in some embodiments, the quenched temperature range may correspond to a range defined by endpoints selected within the range of 200° C. to 500° C. In some embodiments, the quenched temperature range is defined by endpoints selected within a smaller range, such as the range of 200° C. to 350° C. or the range of 200° C. to 250° C. In some examples, a lower end of the range may correspond to 200° C. or other temperature below which coiling for high solute alloys (e.g., alloys in which a sum of solutes such as Magnesium, Silicon, Copper, and/or Zinc is more than 2.0 percent by weight) could result in difficulty for cold rolling. In some embodiments, the quenched temperature range is selected for continuity with a process of achieving a T6, T8, T9 or other particular temper. In some embodiments, the quenched temperature range is selected to facilitate precipitation of dispersoids or to homogenize continuously cast material before subsequent cold work. In some embodiments, the quenched temperature range may correspond to 300° C. to 350° C. or other suitable range for resulting material to be soft enough for subsequent cold rolling and not otherwise too strong for subsequent processing.

In some embodiments, quenching to reach a quenched temperature range may be a result of exposing the unwound portion 124 of the coil 110 to a quenching medium provided within a quenching temperature range (e.g., the temperature of the medium may be referred to as a "quenching" temperature and the resulting temperature of the metal may be referred to as a "quenched" temperature). In some embodiments, the quenching temperature range for the quenching medium may be defined by endpoints selected within the range of 10° C. to 350° C. In some embodiments, water may be used as the quenching medium and may be provided in a liquid form, e.g., at a temperature between 10° C. to 100° C. Providing water in liquid form may allow water to be provided at room temperature or with minimal heating or cooling relative to room temperature and with significantly less energy expenditure than if the water is heated to convert from liquid state to steam. In some embodiments, water or other quenching medium may be provided at a temperature above 100° C. or otherwise in an at least partially non-liquid form. For example, in various scenarios, if water is used as the quenching medium, providing water at a temperature greater than 100° C. will cause the water to be steam and prevent condensation on the quenched portion 130 that could become entrained in the material 112 in a manner that may be deleterious downstream in the process 10.

In some embodiments, the quenching temperature range for the quenching medium may be defined by endpoints selected within the range of 150° C. to 200° C. For example, in various scenarios, providing water at a temperature in such range may strike a balance between incorporating a suitable factor of safety for ensuring the temperature of the water does not inadvertently drop into a range in which condensation may occur, while also providing a sufficiently low temperature of medium for providing a suitable heat extraction rate for causing the material 112 to quench within the predetermined amount of time.

In some embodiments, a range of suitable quenching rates or heat extraction rates may be defined by endpoints selected within the range of 10° C./s and 100° C./s, for example. The heat extraction rate may be selected based on composition and/or other processing to be utilized. For example, different heat extraction rates can be used to deliver different properties downstream. As illustrative examples, a heat extraction rate of 10° C./s may be suitable in situations in which subsequent cold work is to be implemented, or a heat extraction rate of 100° C./s may be suitable to facilitate suppression of ludering in 5xxx alloys.

Non-limiting examples of the predetermined time may be less than an hour, less than 20 minutes, less than 2 minutes, less than 20 seconds, less than 2 seconds, or some other suitable timeframe. The predetermined time may be based on or dependent on a particular target heat extraction rate. In some embodiments, a rate of unwinding of the coil 110 may be used as a corollary or measure that may affect or impart a suitable heat extraction rate. In some embodiments, suitable heat extraction rates may be obtained by a range of unwinding speeds defined by endpoints selected within the range of 1 meter per minute and 100 meters per minute, for example.

The quenching at 60 may involve any suitable sequence of temperature decreases and/or increases. For example, the quenching at 60 may include or be supplemented by a re-heating process. As an illustrative example, the unwound portion 124 of the coil 110 may be initially quenched to a lower temperature (e.g., less than 200° C.) to allow re-tensioning or other beneficial effect, and then re-heated to a higher quenched temperature (e.g., between 200° C. and 350° C.) before coiling anew as at act 70. Any suitable structure may be utilized to provide associated temperature increases, including, but not limited to, additional ovens or oil or other heating medium provided in a suitable bath or via nozzles (e.g., such as if some nozzles or other structure of the quenching system 126 provide quenching medium at a temperature selected to impart heat transfer into the unwound portion 124 and other instances of the nozzles or structure of the quenching system 126 provide quenching medium at a temperature selected to impart heat transfer out of the unwound portion 124).

At act 70, the process 10 can include coiling the quenched portion 130. For example, the quenched portion 130 may be coiled anew or re-coiled to form a second coil 132. This may provide a coil 110 with heat treated and quenched material. Subjecting the coil to a heat treatment process 10 as described may provide a heat-treated coil 110 in which favorable precipitants or other microstructure or characteristics of the coil 110 may be obtained.

Figure 2:
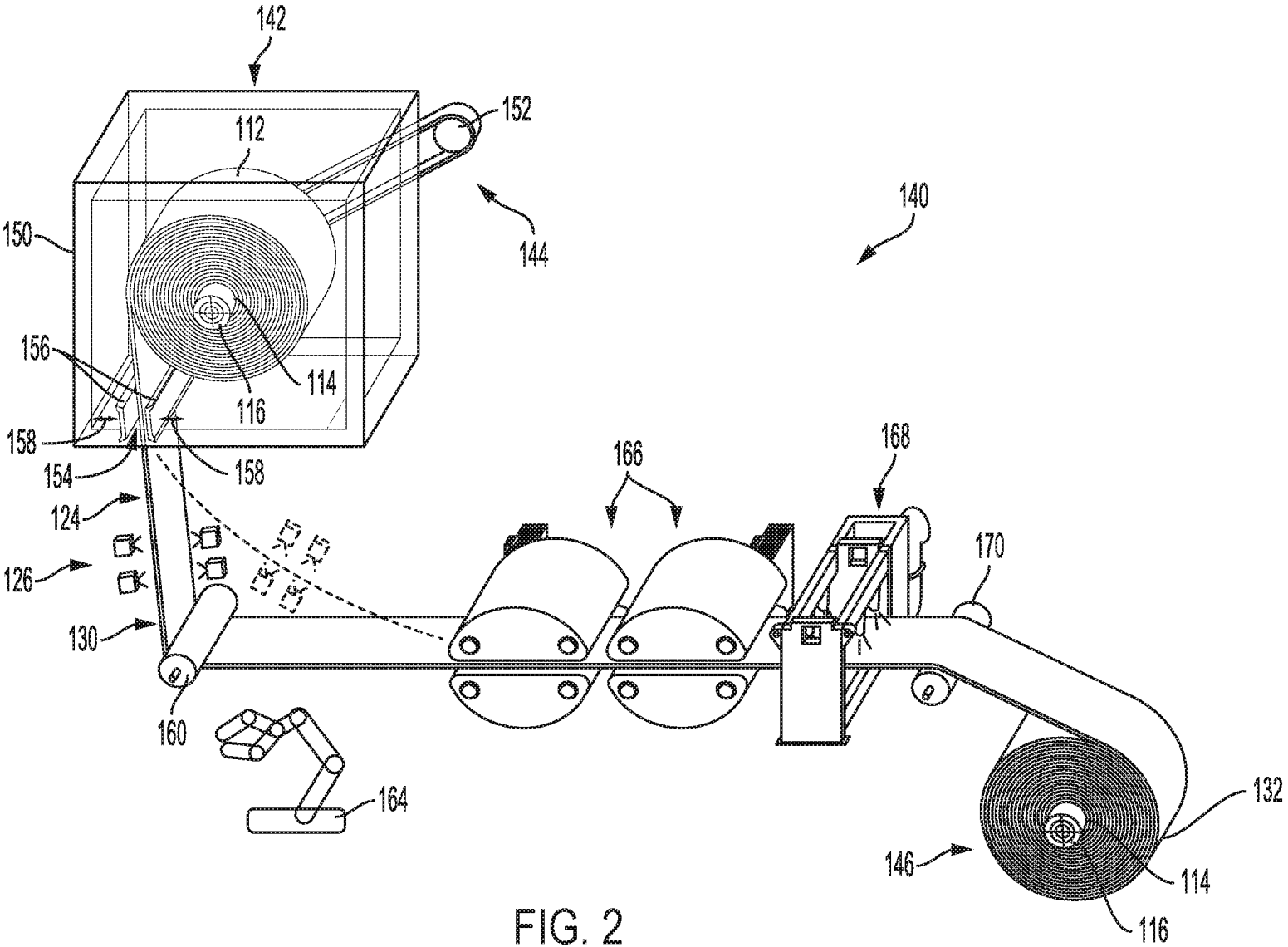
FIG. 2 is a side view of an example of a system that may be used for performing the process of FIG. 1 and shows the coil being uncoiled within the furnace, according to various embodiments.

FIG. 2 is a side view of an example of a system 140 that may be used for performing the process 10 of FIG. 1. The system 140 in FIG. 2 is shown with a furnace 142, an unwinding system 144, a quenching system 126, and a winding system 146, although other elements may be included additionally or alternatively and/or with other variations.

The furnace 142 may be sized for receiving the coil 110. The furnace 142 may be formed of one or more walls 150 that define an interior volume that can be heated by burners or other suitable elements. The furnace 142 may be capable of pre-heating or elevating a temperature of the metal of the coil 110. For example, the furnace may pre-heat or elevate the temperature of the metal to be within a homogenizing temperature range, annealing temperature range, or other particular heated temperature range as discussed at act 40 of heating the coil 110 in FIG. 1. In some embodiments, the interior of the furnace 142 may be an inert environment or otherwise controlled to prevent or reduce possible oxidation of the coil 110.

The unwinding system 144 can include suitable components for unwinding at least a portion of the coil 110. The unwinding system 144 may unwind a part of the coil 110 while the coil 110 is still at an elevated temperature (e.g., per the discussion at act 50 in FIG. 1). In some embodiments, the unwinding system 144 can include a suitable unwinding mechanism 152 for rotating the coil 110. In FIG. 2, the unwinding mechanism 152 is depicted as a motor with a belt operable to rotate a mandrel 116, although any other suitable mechanism may be employed for rotating a mandrel 116 and/or spool 114 that may be engaged and/or supporting the coil 110.

The furnace 142 in FIG. 2 is depicted with an opening 154. The opening 154 can be sized for passage of the unwound portion 124 of the coil 110. The furnace 142 can include suitable structure for defining the size of the opening 154. In some examples, the size of the opening 154 may be varied. For example, the furnace 142 may include one or more doors 156 that may be adjustable (e.g., as illustrated by arrows 158) by actuators or other suitable movement-imparting components to adjust a size of the opening 154 defined by the door 156.

The quenching system 126 can receive the unwound portion 124 of the coil 110 from the unwinding mechanism 152 and/or the furnace 142. The quenching system 126 in FIG. 2 is depicted as a series of jets for delivering quenching medium 128, although the quenching system 126 can correspond to other structures, including, but not limited to, those described with respect to FIG. 1 in relation to the act 60 of quenching. Moreover, although respective pairs of jets are shown in FIG. 2, any number of jets or other structures for delivering quenching medium 128 may be utilized. In some embodiments, successive stages of the quenching system 126 may be provided with quenching medium 128 provided at different (e.g., successively lower) temperatures, for example, which may allow a progression through multiple quenching stages and/or moving between mediums of different temperatures to bring the temperature down over a particular profile or gently over a duration of time.

An initial roller 160 is shown downstream of the quenching system 126 in FIG. 2. Arranging the system 140 so that the material 112 from the coil 110 only contacts the initial roller 160 after already having passed through a quenching system 126 may be advantageous. For example, the initial roller 160 may be less prone to stretch or scratch the material 112 after the material 112 has been quenched than if the initial roller 160 had been brought in contact before the material 112 had been cooled by the quenching system 126. The initial roller 160 can allow tensioning of the material of the coil 110, for example, to facilitate subsequent stages of the process as the material 112 travels through the system 140.

The coil 110 may be arranged in any suitable orientation for passage from the furnace 142 and through the quenching system 126. Although the material 112 is shown in a vertical orientation in solid line in FIG. 2 while exiting the furnace 142 and passing through the quenching system 126, other orientations are also possible. One example of an alternate path is shown in dashed lines in FIG. 2. For example, the material 112 may assume a catenary or other shape as routed.

A robotic arm 164 is also shown within the system 140 in FIG. 2. The robotic arm 164 may be useful for handling an end or initial portion of the unwound portion 124 from the coil 110. For example, the robotic arm 164 may grasp an initial free end unwound from the coil 110 and direct it to a suitable downstream location, such as for introduction into other elements in the system 140.

Other components may be included in the process line. For example in FIG. 2, bridles 166 are shown. The bridles 166 may correspond to magnetic bridles that can advance and/or support the material 112 without physically contacting the material 112.

A lubrication system 168 is also shown in FIG. 2. The lubrication system 168 may include nozzles and/or other suitable structure for applying lubricant to material 112 passing by or through the lubrication system 168. A subsequent roller 170 is shown in FIG. 2. The subsequent roller 170 may be utilized for tensioning or other suitable purposes.

As noted previously, the system 140 may also include a winding system 146. The winding system 146 may re-coil or coil anew with material 112 received from other parts of the system 140. For example the winding system 146 may include another spool 114 and/or mandrel 116 that can be rotated to form a new or second coil 132 of the received material 112. The new or second coil 132 may correspond to material 112 that has been treat heat treated by the system 140.

Figure 3:
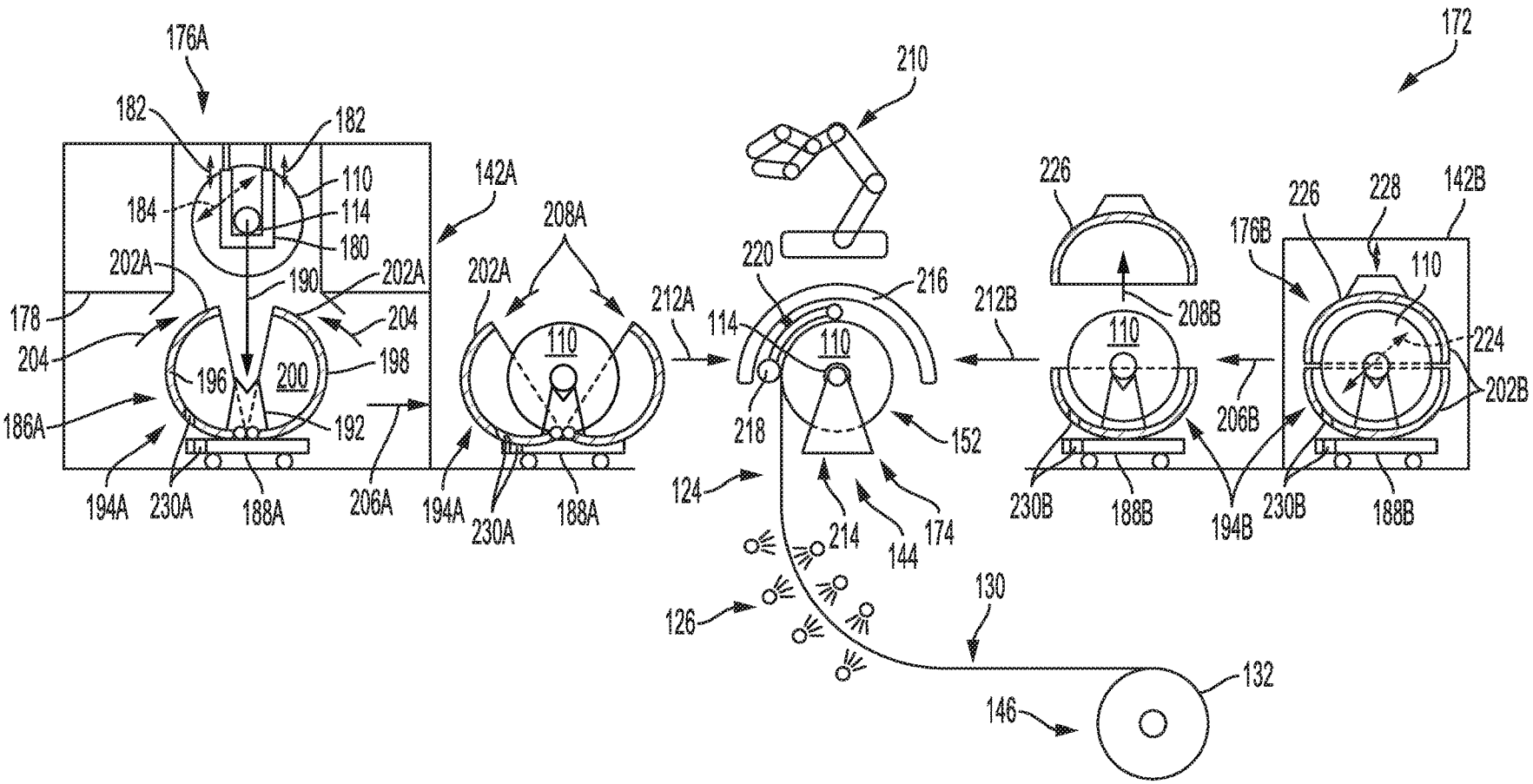
FIG. 3 is a side view of components that may be used for performing the process of FIG. 1 and shows examples of options for transporting the coil to an unwinding location, according to various embodiments.

FIG. 3 is a side view of components of a system 172 that may be used for performing the process 10. FIG. 3 shows examples of options for transporting the coil 110 from a furnace 142 (e.g., either furnace 142A or 142B in FIG. 3) to an unwinding location 174, e.g., where the coil 110 can be unwound while still at an elevated temperature and/or before substantial cooling (e.g., cooling of 50° C. or other threshold amount as discussed herein) has occurred relative to an pre-heated temperature imparted by the furnace 142.

Various options for variations of different components are shown in FIG. 3. For simplicity, examples of various components are shown on the left side of FIG. 3 and will be described first and referenced with reference numerals with suffixes ending with "A", while some variations of such components will thereafter be described with suffixes of "B" with respect to components depicted by way of example at the right side of FIG. 3.

The system 172 in FIG. 3 is shown with a furnace 142A capable of being unloaded from underneath or below. The furnace 142A can be sized to receive a coil 110. The furnace 142A can include or be associated with an unloading system 176A that allows the furnace 142A to be unloaded from a bottom side 178. The unloading system 176A can include suitable hooks 180 or other structures for supporting the coil 110 and/or moving the coil 110. For example, the coil 110 may be supported by a spool 114 and/or mandrel 116, and the spool 114 and/or mandrel 116 may be supported within the furnace 142A by hooks 180 or other structures of the unloading system 176A. Suitable actuators (not shown) may be incorporated to enable movement of the hooks 180 or other structures of the unloading system 176A to facilitate unloading of the coil 110 from the furnace 142A. As non-limiting examples, the hooks 180 or other structures of the unloading system 176A may be moveable vertically (e.g., as depicted by arrows 182) and/or laterally (e.g., which may include a direction corresponding to into or out of the page in FIG. 3 as depicted by arrows 184, and/or a direction corresponding to left or right in the view in FIG. 3).

The furnace 142A may be accompanied by or associated with a transport system 186A. The transport system 186A may be capable of moving the coil 110, such as between the furnace 142A and an unwinding location 174. The transport system 186A may include one or more carriers 188A. The carrier 188A may correspond to a cart, vehicle, movable platform, or any other structure capable of moving the coil 110 from the furnace 142A to the unwinding location 174. Such transport may allow the coil 110 to be unwound while still at a pre-heated temperature imparted by the heating in the furnace 142A, or while at an elevated temperature within a threshold below the pre-heated temperature (e.g., per the discussion at act 50 in FIG. 1). In some embodiments, the carrier 188A (or portion thereof) may be pre-heated, e.g., which may reduce a temperature differential between the coil 110 and a portion of the carrier 188A in a manner that may mitigate against heat loss by the coil 110 during transport by the carrier 188A.

In operation, upon the coil 110 reaching a suitable temperature by heating from the furnace 142A, the unloading system 176A can lower the coil 110, such as depicted by the arrow 190. For example, the coil 110 can be lowered relative to a carrier 188A of the transport system 186A. The coil 110 can be received by the carrier 188A, for example, such that the spool 114 and/or mandrel of the coil 110 is received and supported by a stand 192 (e.g., a fork or other support) of the carrier 188A. Elements of the unloading system 176A may move in appropriate directions to release the coil 110 relative to carrier 188A. For example, the hooks 180 or other structure of the unloading system 176A can move laterally (e.g., as illustrated by arrow 184) and past ends of the spool 114 and/or mandrel of the coil 110, which may correspond to moving clear of the carrier 188A so that the carrier 188A can close, move away from the furnace 142A, and/or perform other actions without interference by elements of the unloading system 176A.

In some embodiments, the elements of the unloading system 176A may function as or be supplemented by elements capable of loading the furnace 142A. For example, the unloading system 176A may perform movements in reverse order to those described for unloading and thereby insert a coil 110 into the furnace 142A from a carrier 188A or other supply source.

The carrier 188A can include an insulating enclosure 194A. The insulating enclosure 194A may be capable of at least partially enclosing the coil 110. The insulating enclosure 194A can include insulation 196 to reduce heat loss of the coil 110 during transport by the carrier 188A. For example, the insulation 196 may be included in sides 198 and/or ends 200 of the insulating enclosure 194A. Non-limiting examples of suitable insulation 196 may include refractory materials.

The term "refractory material" as used herein may include any materials that are relatively resistant to attack by molten metals and that are capable of retaining their strength at the high temperatures contemplated for the material in use. Such materials may include, but are not limited to, ceramic materials (inorganic non-metallic solids and heat-resistant glasses) and non-metals. A non-limiting list of suitable materials for the insulation 196 includes the following: the oxides of aluminum (alumina), silicon (silica, particularly fused silica), magnesium (magnesia), calcium (lime), zirconium (zirconia), boron (boron oxide); metal carbides, borides, nitrides, silicides, such as silicon carbide, particularly nitride-bonded silicon carbide (SiC/Si3N4), boron carbide, boron nitride; aluminosilicates, e.g. calcium aluminum silicate; composite materials (e.g. composites of oxides and non-oxides); glasses, including machinable glasses; mineral wools of fibers or mixtures thereof; carbon or graphite; and the like. As an illustrative example, in some contexts, refractory materials may withstand temperatures up to 1200° C. (e.g., which may be suitable for processing of aluminum or copper, though not likely steel, which tends to be processed at higher temperatures for which other suitable refractory material may nevertheless be available), although in some other contexts, refractory material suitable for processing aluminum and its alloys may be selected to withstand working temperatures in the lesser range of 400 to 800° C.

The carrier 188A can include one or more releasably separable members 202A to facilitate receiving and unloading of the coil 110. The carrier 188A is depicted with two releasably separable members 202A in FIG. 3, and although other numbers including one, two, or more than two could be utilized, for simplicity, description hereafter will primarily refer to a single member 202A. The separable member 202A may be movable between a closed configuration in which the coil 110 is at least partially enclosed by the insulation 196 and an open configuration in which the coil 110 is accessible for loading or unloading relative to the carrier 188A.

As noted previously, in use, the coil 110 can be lowered by the unloading system 176A and toward the carrier 188A, such as depicted by arrow 190. Once the coil 110 is received by the carrier 188A (e.g., with the spool 114 and/or mandrel 116 through the coil 110 being supported by the stand 192 or other support structure within the carrier 188A), the separable member 202 of the carrier 188A can close around the coil 110 (such as depicted by arrows 204), which may effectively insulate the coil 110 and prevent or reduce heat loss from the coil 110 while within the carrier 188A.

The carrier 188A may convey the coil 110 away from the furnace, such as illustrated at arrow 206A. In some embodiments, the carrier 188A may be prepared for removal of the coil 110 by the separable member 202A opening, such as depicted by arrows 208A.

A transfer system 210 may transfer the coil 110 from the carrier 188 and into engagement with an unwinding mechanism 152 at the unwinding location 174 in some embodiments (e.g., as illustrated by arrow 212A). The transfer system 210 is depicted as a robotic arm in FIG. 3, but may correspond to any suitable structure for transferring the coil 110 from the carrier 188A to the unwinding mechanism 152. The unwinding mechanism 152 may include a motor or other device capable of rotating the spool 114 and/or mandrel 116 about which the coil 110 is formed and thus unwind the coil 110.

A resulting unwound portion 124 of the coil 110 may be passed through a quenching system 126 and produce a quenched portion 130 of the coil 110. The quenching system 126 may (but need not) correspond to the components described elsewhere herein—thus, description will not be repeated. The quenched portion 130 subsequent to passage from the quenching system 126 may be coiled anew and form a new or second coil 132 in a similar fashion to the winding system 146 described with respect to FIG. 2.

The system 172 may alternatively or additionally include other components depicted and described with respect to FIG. 2 and or may include other components. As an illustrative example of other elements not depicted in FIG. 2 (but which may be used with the system of FIG. 2 if desired), the unwinding location 174 of the unwinding system 144 in FIG. 3 is at an unwinding station 214 that also includes insulation 216 (e.g., which may be similar to insulation 196) for retention of heat during the unwinding process. Also shown in FIG. 3 is a biased roller 218. The biased roller 218 may be biased by a spring 220 or other biasing mechanism. In some embodiments, the biased roller 218 may be biased solely or at least partially by a weight of the biased roller 218. The biased roller 218 may provide amounts of force appropriate to prevent an end or other portion of the coil 110 near the biased roller 218 from "springing away" from other laps of the coil 110 in use. The biased roller 218 may be pivotally mounted and/or otherwise capable of changing position to remain pressed or otherwise in engagement with the coil 110 so that contact with the coil is maintained even as the coil 110 reduces in diameter due to being unwound by the unwinding mechanism 152.

Components shown in the system 172 in FIG. 3 may alternatively be used in the system 140 of FIG. 2 or vice versa. For example, although the biased roller 218 shown in FIG. 3 is not also depicted in FIG. 2, the biased roller 218 could nevertheless be implemented at a suitable location within the system 140 described with respect to FIG. 2. Similarly, the insulation 216 and/or insulation 196 described with respect to FIG. 3 could also be arranged in a relevant manner with respect to the system 140 of FIG. 2.

Other variations are shown at the right side of FIG. 3. For example, in some embodiments, the system 172 may implement a furnace 142B capable of unloading from a side of the furnace 142B and/or from beside the furnace 142B. An unloading system 176B may push or pull the coil 110 out of the furnace 142B in a lateral direction, such as in a direction generally corresponding to a direction out of the page in FIG. 3, e.g., graphically depicted by the double-headed arrow 224. The unloading system 176B may additionally or alternatively be capable of moving the coil 110 in a vertical direction, e.g., to move up and over structure of the carrier 188B and into a position of being supported by a stand 192 or otherwise into an interior defined within the carrier 188B.

The carrier 188B and insulating enclosure 194B depicted at right in FIG. 3 differs from those shown at left in FIG. 3. In the carrier 188B and insulating enclosure 194B at right in FIG. 3, for example, the insulating enclosure 194B may include one or more releasably separable members 202B that can be closed with a technique that may correspond to linearly aligning tube parts (e.g., in contrast to the clamshell-like or hinged approach of the carrier 188A at left in FIG. 3).

In use, the insulating enclosure 194B at right in FIG. 3 may include a lid 226 or other element that can be raised and/or lowered (such as by depicted by arrow 228) or otherwise moved into engagement with other portions of the insulating enclosure 12B. The carrier 188B may move the coil 110 away from the furnace 142B (as at arrow 206B and akin to arrow 206A). After a suitable distance has been traversed by the carrier 188B, the insulating enclosure 194B may be opened to allow access to the coil 110. For example, the lid 226 of the insulating enclosure 194B may be lifted as at arrow 208B.

As illustrated e.g., by arrow 212B, the coil 110 may be transferred to the unwinding location 174 by the transfer system 210 in some embodiments. This may allow the coil 110 to be unwound, quenched by the quenching system 126, and re-wound by the winding system 146, in a manner similar to that described previously with respect to the coil 110 provided from the left side of FIG. 3.

In some embodiments, different types of unloading system 176 and/or transport system 186 (e.g., including carrier 188 and/or associated components) may be utilized and suitable for different styles of furnace 142. For example, a clam-shell type of insulating enclosure 194A may be well-suited to forming an upward facing opening for receiving from a bottom-loading furnace 142A, while an insulating enclosure 194B with linearly aligning tube parts may be well-suited for lowering over an unloading zone adjacent a side-loading furnace 142B. Nevertheless, the respective types of furnace 142 are not limited to such options or the context shown in FIG. 3 by way of example, and elements in FIG. 3 (or variations thereof) may be utilized with any other desired combination of elements.

Additionally, any suitable combination of one-to-one, one-to-many, or many-to-many options are possible. For example, although the arrangement at the right of FIG. 3 shows a single furnace 142 that may load into an individual carrier 188, in some embodiments, a single carrier 188 may service multiple furnaces 142 (such as at the left in FIG. 3, where an individual carrier 188 is arranged for servicing any one of three different furnaces 142 shown overhead of the carrier 188). In some embodiments, multiple carriers 188 may be used relative to an individual furnace 142, e.g., such that one carrier 188 may carry away a heated coil 110 while another carrier positions a fresh coil 110 for loading into and heating within the furnace 142. FIG. 3 by way of example also shows that an unwinding location 174 may serve multiple carriers 188 and/or furnaces 142. Using an unwinding station 214 in conjunction with multiple furnaces 142 may allow efficiency in equipment usage (e.g., if an unwinding process is faster than heating processes, start times between heating in different furnaces could be staggered to allow an unwinding mechanism 152 to be in more frequent use and have less down time between cycles). Additionally or alternatively, different furnaces 142 may be serviced by a single carrier 188, such as to reduce complexity and/or cost of elements within the system 172.

In some embodiments, the coil 110 may be unwound at the unwinding location 174 without first being removed from the carrier 188. For example, the carrier 188 may include an aperture 230 (identified respectively as 230A and 230B in FIG. 3) through which an unwound portion 124 of the coil 110 can be passed for routing to the quenching system 126 and or other portions of the process line or system 172. The aperture 230 may be sized to allow the coil 110 to be unwound and passed through the aperture 230 at the unwinding location 174. In some embodiments, the carrier 188 may engage with the unwinding mechanism 152 at the unwinding location 174 to cause the coil 110 to be unwound through the carrier 188. In some embodiments, however, the unwinding mechanism 152 may include at least some portion self-contained within or on the carrier 188, e.g., which may provide additional flexibility as to locations at which the coil 110 can be unwound from within the carrier 188. Moreover, in scenarios in which the unwinding mechanism 152 is at least partially self-contained within or on the carrier 188, the transfer system 210 and/or a separate unwinding mechanism 152 at the unwinding location 174 may be obviated.

ILLUSTRATIVE ASPECTS

In some aspects, a device, a system, or a method is provided according to one or more of the following aspects or according to some combination of the elements thereof. In some aspects, features of a device or a system described in one or more of these aspects can be utilized within a method described in one of the other aspects, or vice versa.

Aspect 1 is a method for heat-treating a coil of metal, the method comprising: heating the coil of metal within a furnace to elevate a temperature of the metal to be within a pre-heated temperature range corresponding to a homogenizing temperature range or an annealing temperature range; unwinding the coil of metal in a heated state in which the metal is within the pre-heated temperature range or before the metal has cooled past a threshold amount below the pre-heated temperature range, wherein the unwinding produces an unwound portion of the coil; and quenching the unwound portion of the coil to reduce a temperature of the unwound portion to a quenched temperature range within a predetermined amount of time, wherein the quenching produces a quenched portion.

Aspect 2 is the method of aspect(s) 1 (or of any other preceding or subsequent aspects individually or in combination), wherein either: at least part of the unwinding of the coil is performed while the coil is maintained within the furnace; or between the heating of the coil and at least a part of the unwinding of the coil, the coil is transported between the furnace and an unwinding location.

Aspect 3 is the method of aspect(s) 1 (or of any other preceding or subsequent aspects individually or in combination), wherein the heating, unwinding, and quenching are performed with the coil maintained in a continuous band of material without the band being subject to severing and re-connecting.

Aspect 4 is the method of aspect(s) 1 (or of any other preceding or subsequent aspects individually or in combination), further comprising: re-coiling the quenched portion into a second coil.

Aspect 5 is the method of aspect(s) 1 (or of any other preceding or subsequent aspects individually or in combination), further comprising: between the heating of the coil and at least a part of the unwinding of the coil, transporting the coil between the furnace that performed the heating of the coil and an unwinding location.

Aspect 6 is the method of aspect(s) 5 (or of any other preceding or subsequent aspects individually or in combination), further comprising unloading the coil from the furnace from below or beside the furnace.

Aspect 7 is the method of aspect(s) 5 (or of any other preceding or subsequent aspects individually or in combination), further comprising at least partially encasing the coil with insulation material to reduce heat loss during the transporting of the coil.

Aspect 8 is the method of aspect(s) 1 (or of any other preceding or subsequent aspects individually or in combination), wherein at least part of the unwinding of the coil is performed while the coil is maintained within the furnace that performed the heating of the coil.

Aspect 9 is the method of aspect(s) 1 (or of any other preceding or subsequent aspects individually or in combination), further comprising: inserting a mandrel into a spool about which the coil is formed; and rotating the mandrel, wherein the unwinding of the coil results from the mandrel rotating.

Aspect 10 is the method of aspect(s) 9 (or of any other preceding or subsequent aspects individually or in combination), wherein the inserting of the mandrel occurs before the heating of the coil, and wherein the mandrel is configured to radially expand for adapting to a change in size of an inner diameter of the spool resulting from the heating of the coil.

Aspect 11 is the method of aspect(s) 1 (or of any other preceding or subsequent aspects individually or in combination), wherein the metal comprises aluminum.

Aspect 12 is the method of aspect(s) 1 (or of any other preceding or subsequent aspects individually or in combination), wherein the pre-heated temperature range corresponds to a homogenizing temperature range between 400° C. and 600° C.

Aspect 13 is the method of aspect(s) 1 (or of any other preceding or subsequent aspects individually or in combination), wherein the pre-heated temperature range corresponds to an annealing temperature range between 300° C. and 500° C.

Aspect 14 is the method of aspect(s) 1 (or of any other preceding or subsequent aspects individually or in combination), wherein the threshold amount is 50° C. or less.

Aspect 15 is the method of aspect(s) 1 (or of any other preceding or subsequent aspects individually or in combination), wherein the quenched temperature range resulting from the quenching is between 200° C. and 500° C.

Aspect 16 is the method of aspect(s) 1 (or of any other preceding or subsequent aspects individually or in combination), wherein the quenched temperature range resulting from the quenching is between 200° C. and 350° C.

Aspect 17 is the method of aspect(s) 1 (or of any other preceding or subsequent aspects individually or in combination), wherein the quenching comprises subjecting the unwound portion of the coil to a quenching medium provided in a quenching temperature range between 100° C. and 250° C.

Aspect 18 is the method of aspect(s) 1 (or of any other preceding or subsequent aspects individually or in combination), wherein the quenching comprises subjecting the unwound portion of the coil to a quenching medium provided in a quenching temperature range between 10° C. and 200° C.

Aspect 19 is the method of aspect(s) 1 (or of any other preceding or subsequent aspects individually or in combination), wherein the predetermined amount of time is less than 20 seconds.

Aspect 20 is the method of aspect(s) 1 (or of any other preceding or subsequent aspects individually or in combination), wherein the quenching corresponds to a heat extraction rate greater than 10° C./s.

Aspect 21 is the method of aspect(s) 1 (or of any other preceding or subsequent aspects individually or in combination), wherein the quenching corresponds to a heat extraction rate less than 100° C./s.

Aspect 22 is a system for heat-treating a coil of metal, the system comprising: a furnace sized for receiving the coil of metal and configured for elevating a temperature of the metal to be within a pre-heated temperature range corresponding to a homogenizing temperature range or an annealing temperature range; an unwinding system operable to unwind at least a portion of the coil in a heated state in which the metal is within the pre-heated temperature range or before the metal has cooled past a threshold amount below the pre-heated temperature range; and a quenching system configured to receive an unwound portion of the coil from the unwinding system and reduce a temperature of the unwound portion to a quenched temperature range within a predetermined amount of time.

Aspect 23 is the system of aspect(s) 22 (or of any other preceding or subsequent aspects individually or in combination), wherein either: the system further comprise a transport system configured to move the coil between the furnace and an unwinding location of the unwinding system; or the unwinding system comprises an unwinding mechanism configured to at least partially unwind the coil while the coil is located within the furnace to produce an unwound portion of the coil.

Aspect 24 is the system of aspect(s) 22 (or of any other preceding or subsequent aspects individually or in combination), further comprising a winding system configured to receive a quenched portion from the quenching system and re-coil the quenched portion to form a second coil.

Aspect 25 is the system of aspect(s) 22 (or of any other preceding or subsequent aspects individually or in combination), further comprising a transport system configured to move the coil between the furnace and an unwinding location of the unwinding system.

Aspect 26 is the system of aspect(s) 25 (or of any other preceding or subsequent aspects individually or in combination), wherein the transport system comprises at least one carrier configured to receive the coil in the heated state and transport the coil to the unwinding location in the heated state.

Aspect 27 is the system of aspect(s) 26 (or of any other preceding or subsequent aspects individually or in combination), wherein the carrier is configured to receive an insulating enclosure about the coil.

Aspect 28 is the system of aspect(s) 27 (or of any other preceding or subsequent aspects individually or in combination), wherein the insulating enclosure comprises at least one releasably separable member movable between a closed configuration in which the coil is at least partially enclosed by insulation and an open configuration in which the coil is accessible for loading or unloading relative to the carrier.

Aspect 29 is the system of aspect(s) 27 (or of any other preceding or subsequent aspects individually or in combination), wherein the insulating enclosure comprises an aperture sized to allow the coil to be unwound and passed through the aperture at the unwinding location.

Aspect 30 is the system of aspect(s) 26 (or of any other preceding or subsequent aspects individually or in combination), further comprising a transfer system configured to transfer the coil in the heated state from the carrier to and into engagement with an unwinding mechanism at the unwinding location.

Aspect 31 is the system of aspect(s) 22 (or of any other preceding or subsequent aspects individually or in combination), further comprising insulation arranged relative to an unwinding location of the unwinding system to prevent or reduce heat loss from the coil when received at the unwinding location.

Aspect 32 is the system of aspect(s) 22 (or of any other preceding or subsequent aspects individually or in combination), wherein the unwinding system comprises an unwinding mechanism configured to at least partially unwind the coil while the coil is located within the furnace to produce an unwound portion of the coil.

Aspect 33 is the system of aspect(s) 22 (or of any other preceding or subsequent aspects individually or in combination), wherein the furnace comprises an opening sized for passage of the unwound portion of the coil.

Aspect 34 is the system of aspect(s) 33 (or of any other preceding or subsequent aspects individually or in combination), wherein the opening has a size defined by at least one door movable to adjust the size of the opening.

Aspect 35 is a system for heat-treating a coil of metal, the system comprising: a furnace sized for receiving the coil of metal and configured for elevating a temperature of the metal to be within a pre-heated temperature range corresponding to a homogenizing temperature range or an annealing temperature range; a transport system configured to move the coil away from the furnace in a heated state in which the metal is within the pre-heated temperature range or before the metal has cooled past a threshold amount below the pre-heated temperature range; an unwinding system operable to unwind at least a portion of the coil in the heated state at an unwinding location to which the coil has been delivered by the transport system; and a quenching system configured to receive an unwound portion of the coil from the unwinding system and reduce a temperature of the unwound portion to a quenched temperature range within a predetermined amount of time.

Aspect 36 is a system for heat-treating a coil of metal, the system comprising: a furnace sized for receiving the coil of metal and configured for elevating a temperature of the metal to be within a pre-heated temperature range corresponding to a homogenizing temperature range or an annealing temperature range; an unwinding system comprising an unwinding mechanism operable on the coil to unwind at least a portion of the coil while the coil is located within the furnace; and a quenching system configured to receive an unwound portion of the coil from the furnace and reduce a temperature of the unwound portion to a quenched temperature range within a predetermined amount of time.

All patents, publications, and abstracts cited above are incorporated herein by reference in their entirety. The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A method for heat-treating a coil of metal, the method comprising:

heating the coil of metal within furnace heating section of a furnace to elevate a temperature of the metal to be within a pre-heated temperature range corresponding to a homogenizing temperature range or an annealing temperature range;

unwinding the coil of metal in a heated state in which the metal is within the pre-heated temperature range or before the metal has cooled past a threshold amount of 50° C. or less below the pre-heated temperature range, wherein the unwinding produces an unwound portion of the coil;

between the heating of the coil and at least a part of the unwinding of the coil, transporting the coil between the furnace heating section that performed the heating of the coil and an unwinding location; and quenching the unwound portion of the coil to reduce a temperature of the unwound portion to a quenched temperature range within a predetermined amount of time less than 20 seconds, wherein the quenching produces a quenched portion.

2. The method of claim 1, wherein the heating, unwinding, and quenching are performed with the coil maintained in a continuous band of material without the band being subject to severing and re-connecting.

3. The method of claim 1, further comprising:

re-coiling the quenched portion into a second coil.

4. The method of claim 1, further comprising unloading the coil from the furnace from below or beside the furnace.

5. The method of claim 1, further comprising at least partially encasing the coil with insulation material to reduce heat loss during the transporting of the coil.

6. The method of claim 1, further comprising:

inserting a mandrel into a spool about which the coil is formed, wherein the inserting of the mandrel occurs before the heating of the coil, and wherein the mandrel is configured to radially expand for adapting to a change in size of an inner diameter of the spool resulting from the heating of the coil; and rotating the mandrel, wherein the unwinding of the coil results from the mandrel rotating.

7. The method of claim 1, wherein the metal comprises aluminum.

8. The method of claim 1, wherein the pre-heated temperature range corresponds to a homogenizing temperature range between 400° C. and 600° C.

9. The method of claim 1, wherein the pre-heated temperature range corresponds to an annealing temperature range between 300° C. and 500° C.

10. The method of claim 1, wherein the quenched temperature range resulting from the quenching is between 200° C. and 500° C.

11. The method of claim 1, wherein the quenched temperature range resulting from the quenching is between 200° C. and 350° C.

12. The method of claim 1, wherein the quenching comprises subjecting the unwound portion of the coil to a quenching medium provided in a quenching temperature range between 100° C. and 250° C.

13. The method of claim 1, wherein the quenching comprises subjecting the unwound portion of the coil to a quenching medium provided in a quenching temperature range between 10° C. and 200° C.

14. The method of claim 1, wherein the quenching corresponds to a heat extraction rate greater than 10° C./s.

15. The method of claim 1, wherein the quenching corresponds to a heat extraction rate less than 100° C./s.

* * * * *